United States Patent [19]

Vallance et al.

[11] 4,360,317

[45] Nov. 23, 1982

[54] THREE CYCLE PER REVOLUTION WAVE COMPRESSION SUPERCHARGER

[75] Inventors: James K. Vallance, Northville; Christian J. Rahnke, Orchard Lake, both of Mich.

[73] Assignee: Ford Motor Company, Dearborn, Mich.

[21] Appl. No.: 174,320

[22] Filed: Aug. 1, 1980

[51] Int. Cl.[3] ..... F04F 11/00

[52] U.S. Cl. ..... 417/64

[58] Field of Search ..... 417/64; 60/39.45 A; 123/559

[56] References Cited

U.S. PATENT DOCUMENTS

| | | | |
|---|---|---|---|
| 3,078,034 | 2/1963 | Spalding | 60/39.45 A |
| 3,164,318 | 1/1965 | Barnes et al. | 60/39.45 A |
| 4,002,414 | 1/1977 | Coleman et al. | 417/64 X |
| 4,274,811 | 6/1981 | Rao | 417/64 |

FOREIGN PATENT DOCUMENTS

| | | | |
|---|---|---|---|
| 1384959 | 2/1975 | United Kingdom | 417/64 |

OTHER PUBLICATIONS

"Performance and Sociability of Comprex Supercharged Diesel Engines" by Groenewold et al., published by Amer. Society of Mechanical Engineers, Sep. 18-22, 1977.

*Primary Examiner*—Carlton R. Croyle
*Assistant Examiner*—Edward Look
*Attorney, Agent, or Firm*—F. G. McKenzie; D. J. Harrington

[57] ABSTRACT

A supercharger for compressing air supplied to an engine, wherein the energy of the exhaust gas is used to increase the pressure of the air admitted to the engine, has a rotor with radially extending vanes that define a plurality of rotating cells therebetween. Exhaust gas inlet and outlet ports at one axial end of the rotor and air inlet and outlet ports at the opposite end of the rotor admit engine exhaust gas and ambient air to the rotor cells and permit the flow of exhaust gas and compressed air from the rotor cells. The inlet and exhaust ports of the exhaust gas port plate are correspondingly equal in size and symmetrically disposed around the rotor circumference. The inlet and exhaust ports of the air port plate are unsymmetrically arranged around the rotor circumference and are of unequal size. A first air inlet port has an air outlet port associated with a first compression cycle; a second air inlet port has an air outlet port associated with a second compression cycle; a third air inlet port has an air outlet port associated with a third compression cycle. Each cycle operates with optimal efficiency at discrete rotor speeds.

3 Claims, 4 Drawing Figures

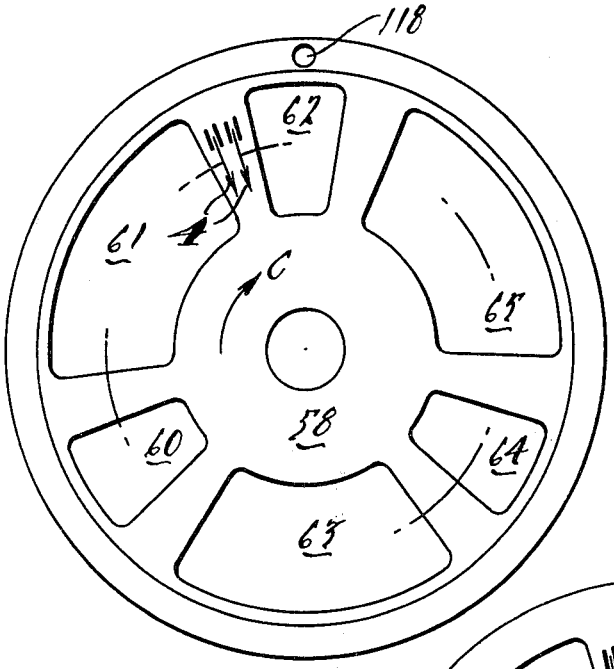
FIG. 2.
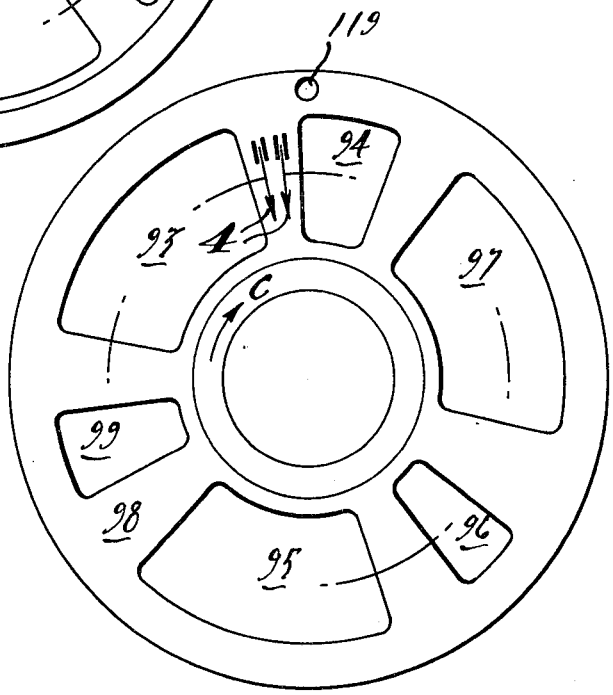
FIG. 3.
FIG. 4.
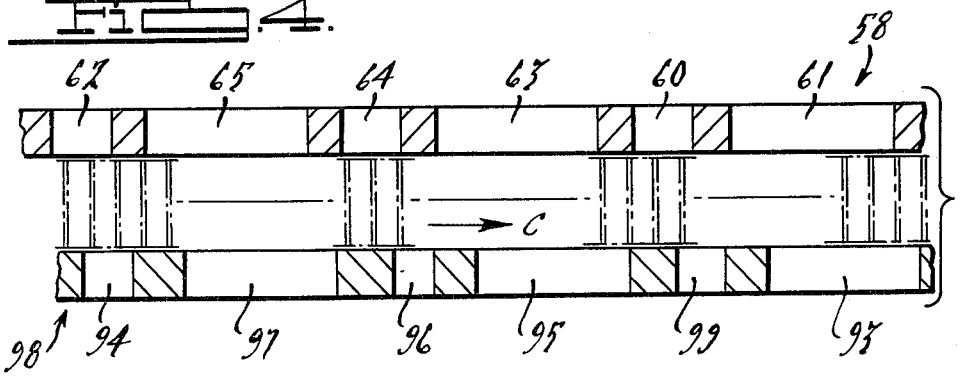

THREE CYCLE PER REVOLUTION WAVE COMPRESSION SUPERCHARGER

BACKGROUND OF THE INVENTION

1. Field of the Invention

This invention relates to a wave compression supercharger wherein the energy of the exhaust gas of an engine is used to compress air inducted into the engine. More particularly, the invention pertains to such a supercharger wherein three complete cycles of wave compression occur during a single rotor revolution.

2. Description of the Prior Art

Our invention comprises improvements in a wave compression supercharger of the kind that is described in a publication of *The American Society of Mechanical Engineers,* dated Sept. 18–22, 1977 entitled, "Performance and Sociability of Comprex Supercharged Diesel Engines".

A wave compression supercharger is a device for producing an exchange of energy between pressurized, hot exhaust gas of an internal combustion engine and air at atmospheric pressure. Within the supercharger the ambient air is compressed and the exhaust gas expanded.

A conventional wave compression supercharger includes a cylindrical rotor having radially directed vanes extending from its outer surface. Generally, stationary port plates are positioned at opposite ends of the rotor and have inlet openings formed through their thicknesses to allow exhaust gas and ambient air to flow into the rotor. Additional openings are provided in the port plates through which the expanded exhaust gas and compressed air flow from the rotor. The pressure exchange takes place within the rotor cells defined by the spaces between the rotor vanes. The process for compressing the ambient air begins when a rotor cell rotates into general alignment with the air inlet port thereby allowing ambient air to flow into and to fill the rotor cell. Rotation then brings the rotor cell into general alignment with the exhaust gas inlet port thus admitting into the cell a compression wave, which begins to travel along the rotor in the direction of the inlet air port. The compression wave travels along the rotor ahead of the engine exhaust gas and operates to compress the air in the rotor cell as it travels axially toward the air port plate. The rotor will have rotated out of communication with the air inlet port when the compression wave has begun to travel down the rotor length thereby sealing the air side of the rotor cell.

Immediately before the compression wave reaches the air side of the rotor, the cell rotates out of alignment with the exhaust gas inlet port. Next, the rotor brings the cell to the air outlet port thus allowing the compressed air to be pumped from the rotor due to the action of the compressed wave traveling to the air side of the rotor. The rotor then brings the cell out of communication with the air outlet port and for a brief period the rotor cell is closed at both ends. In a similar way, the exhaust gas is purged from the rotor cell after the pressure wave rebounds from the air port plate surface. The rotor cell rotates into alignment with the exhaust gas outlet port when the rebounding compression wave returns to the exhaust gas port plate. At the air side of the rotor, the cell is open to ambient air during the latter portion of the compression wave movement to the gas side so that a partial vacuum tending to resist movement of the returning compression wave is avoided.

For efficient operation, it is necessary that the compression wave reaches the air side of the cell precisely as the cell rotates out of alignment with the high pressure air exhaust port. This port must be sized and positioned carefully with respect to the rotor cell and the air inlet port so that the rotor brings the cell to the port when the air in the cell has been compressed to a sufficient pressure, but before the engine exhaust gas, located behind the compression wave, reaches the end of the cell.

In view of the timed sequence of events within a wave compression supercharger with respect to the rotor speed, the position and location of the gas and air inlet and outlet ports and of the advance and return of the pressure wave along the rotor length, it can be appreciated that the device will operate efficiently generally at only one speed. However, the engine of the vehicle that drives the rotor must operate over a wide range of speed. It is, therefore, desirable to expand the efficient operating range of the supercharger to a greater portion of the speed range of the engine.

Recognizing the need to expand the optimal speed range of a wave compression supercharger, air and gas port plates have been mounted for angular adjustment so that the location of the ports formed through their thicknesses can vary as the rotor speed varies. A supercharger of this kind has been described in U.S. patent application Ser. No. 99,245, filed Dec. 3, 1979. Superchargers having the general characteristics in operation as described herein have been disclosed in U.S. patent applications Ser. No. 90,948, filed Nov. 5, 1979 and Ser. No. 32,324, filed Apr. 23, 1979, all assigned to the assignee of the present patent application.

Conventional wave compression superchargers have two sets of ports formed in each air port plate and exhaust gas port plate. These sets of port are identically spaced around the circumference of the rotor and are sized so that the two inlet ports and the two outlet ports have respectively equal areas. Furthermore, the ports are spaced symmetrically around the rotor circumference. This disposition of the air inlet and exhaust port permits two complete suction and compression cycles within each rotor cell for every revolution of the rotor. A high frequency siren-like noise is an operating characteristic of a wave compression supercharger of this convention type. The noise is recognized to be a serious problem in automotive usage.

The spacing of the ports and the circumferential length over which they extend is conventionally selected to produce the most efficient operation of the supercharger at a particular engine speed. The engine speed corresponding to the sizing of the ports is the speed at which the supercharger is required to produce positive boost, usually at or near the engine idle speed.

Conventional wave compression superchargers have two compression cycles for each revolution of the rotor. The air port plate has two large inlet ports of equal size and two smaller outlet ports of equal size formed through its thickness. The ports are distributed about the central axis of the rotor and extend in the circumferential direction a predetermined portion of the total circumference. Each port extends radially a distance that corresponds generally to the radial depth of the rotor cells.

Each compression cycle has one associated air inlet port and one air outlet port; the inlet ports are disposed between the outlet ports. Therefore, each compression cycle occurs during one-half of each rotor revolution because the several ports are arranged around the rotor circumference symmetrically about the central axis of the rotor. The arcuate distance between the adjacent edges of the inlet and outlet ports is the same for each compression cycle.

SUMMARY OF THE INVENTION

The wave compression supercharger according to our invention produces three compression cycles per revolution of the rotor shaft. A rotor mounted for rotation about its axis has vanes extending radially from and distributed circumferentially about the axis, the vanes defining rotor cells therebetween that extend along the axis. At one axial end of the rotor, an exhaust gas port plate has three inlet ports formed through its thickness through which exhaust gas from the engine enters the rotor cells as they rotate into registry with the inlet gas ports. Also formed in the exhaust gas port plate are three gas outlet ports through which exhaust gas from the engine exits the rotor, each gas inlet port being interposed between successive gas outlet ports around the rotor circumference. At the axially opposite end of the rotor an airport plate has three air inlet ports formed through its thickness through which air at low pressure enters the rotor cells. Also formed in the air port plate are three air outlet ports through which compressed air exits the rotor cell, each outlet port being interposed between successive air outlet ports around the rotor circumference. Three compression cycles occur during each rotor revolution. One compression cycle is associated with each air inlet port and the next succeeding air outlet port in the direction of rotation. Similarly, one compression cycle is associated with each gas outlet port and the next succeeding gas inlet port in the direction of rotation.

An object of our invention is to reduce the length of the rotor and the overall size of the wave compression supercharger as compared to such a device having two compression cycles per rotor revolution. Because of the extremely high operating temperatures of a supercharger, the rotor is generally formed from Invar, an expensive metal alloy. A lower cost rotor results with the three cycle compression wave device because the rotor can be shortened by approximately one-third, reducing proportionately the amount of Invar used and the cost associated with its machining.

The second advantage resulting from a shortened rotor is that the clearances between the axial ends of the rotor and the adjacent port plates can be held to a closer tolerance at the operating temperatures of the supercharger. These clearances are set when the supercharger is assembled at room temperature and increase at elevated operating temperatures because of the greater thermal expansion of the housing as compared to the thermal growth of the Invar rotor. It is preferable to keep the end clearances to a minimum to prevent leakage of exhaust gas and air as they enter and exit the rotor. The shorter rotor will effectively reduce the end clearances proportionately with the reduction that can be realized in rotor length.

A second object of our invention is to provide a wave compression supercharger having improved exhaust gas recirculation, flow rate, and compression ratio. This object is realized because the stagnation area, measured by the portion of the rotor circumference it occupies, of the two-cycle device is reduced with this three cycle supercharger. Because of its relatively long dwell time, the two-cycle per revolution supercharger allows the exhaust gas-air interface to travel only a portion of the distance from the exhaust gas side to the air side of the rotor. When a third compression cycle is added, the exhaust gas-air interface travels further down the shortened rotor length. Exhaust gas recirculation is improved with the three-cycle device and the flow rates increase to about 15 pounds per minute of compressed air pumped from the compressor. Higher compression rates result also.

A further object of our invention is to provide a three-cycle wave compression supercharger wherein that portion of the rotor circumference associated with each compression cycle is unequal. Furthermore, the sizing of the various ports, the duration of the dwell period between port openings, and the length of the rotor are chosen to produce optimum performance at three different rotor speeds, thus over a broader range of engine speed.

A further object of this invention is to reduce the high frequency noise of the supercharger by varying that portion of the rotor circumference that is associated with each compression cycle.

BRIEF DESCRIPTION OF THE DRAWINGS

FIG. 2 is a front elevational view of the exhaust gas port plate taken at section 2—2 of FIG. 1 showing three pairs of inlet and outlet ports formed through its thickness equally spaced and symmetrically arranged around the central axis.

FIG. 3 is a front elevational view of the air port plate taken at section 3—3 of FIG. 1 showing three pairs of inlet and outlet ports formed through its thickness unequally spaced and unsymmetrically disposed around the central axis, the inlet ports being of unequal size.

FIG. 4 is a cross section taken at arcuate section line 4—4 showing the air port plate and the exhaust gas port plate disposed at opposite axial ends of the rotor, the inlet and outlet ports being arranged in their proper angular relation.

DESCRIPTION OF THE PREFERRED EMBODIMENTS

Figure 1:
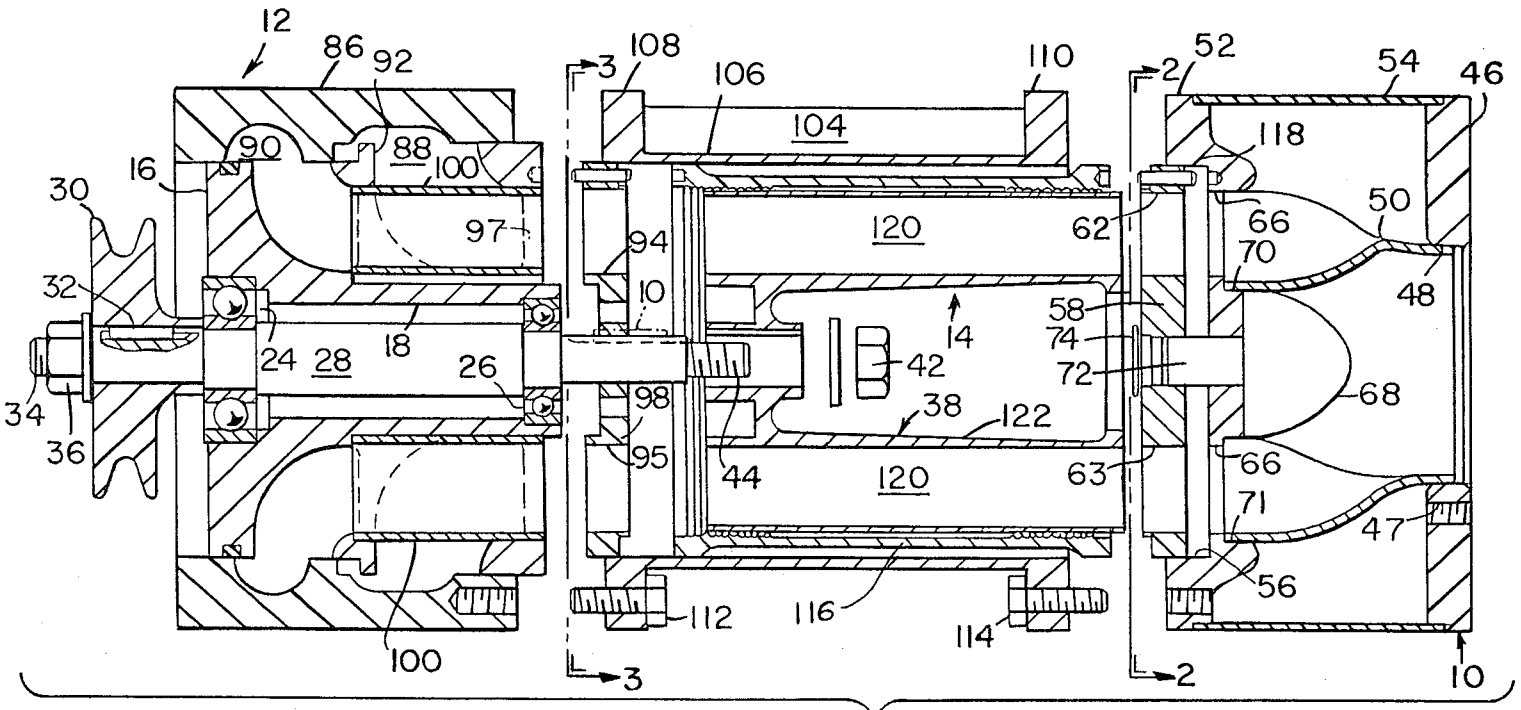
FIG. 1 is an elevation cross-section of a wave compression supercharger showing certain individual parts axially spaced with respect to one another.

Referring first to FIG. 1, a wave compression supercharger according to the present invention includes an exhaust gas duct assembly 10 positioned at one end, an air duct assembly 12 at the opposite end and a rotor assembly 14 interposed between the duct assemblies.

The air duct assembly 12 includes a bearing housing 16, which has an axial bore 18 extending along its length establishing its principal inside diameter. Recesses 20, 22 are formed on the bore 18 and fitted with roller bearings 24, 26. A pulley 30 is secured at the keyway 32 to the overhung outer surface of the shaft 28 mounted within housing 16 on the bearings. In this way, torque from the engine crankshaft is transferred to the pulley by way of the belt and rotation of the shaft about its central axis results. Generally the speed of the rotor is three times the engine speed and rotor speeds will vary between the range 1,300 rpm at idle and 4,500 rpm at cruise. The pulley 30 is retained on the shaft by the engagement of a nut 36 on the externally threaded portion 34 of the shaft 28, which engagement causes the pulley to be drawn up securely and to be retained between bearing 24 and the retaining nut 36. Similarly, at the axially opposite end of shaft 28, rotor 14 is secured against relative rotation with respect to the shaft by a keyway 40 and a retaining nut 42, which is drawn up on an externally threaded portion 44 of shaft 28 thereby fixing the rotor on the shaft.

The exhaust gas duct assembly 10 includes a circular rear mounting plate 46 having a plurality of tapped holes 47 arranged around the central circular opening 48 into which an inner exhaust duct shroud is fitted. The tapped holes 47 provide a means for attaching the supercharger to the motor vehicle structure.

A port retainer flange 52, located in a plane parallel to the plane occupied by the rear mounting plate 46, is spaced axially therefrom by an outer shroud 54 having the form of a right circular cylinder that is mounted upon and joined to plate 46 and the flange 52. A cylindrical bore 56 is formed partially through the thickness of the port retainer flange 52 and provides a recess wherein an exhaust gas port plate 58 is mounted.

FIG. 2 illustrates a front view of exhaust gas port plate 58 showing the gas inlet ports 60, 62, 64 and gas outlet ports 61, 63, 65 formed through the thickness of the port plate. Port retainer flange 52 has gas inlet ports and outlet ports 66 that are identically arranged and aligned substantially with the inlet and outlet ports of the gas port plate 58. An inner shroud 50 is joined to the port retainer flange 52 on surfaces 70, 71. Mounted within the inner shroud on the axial centerline of the supercharger is the center body 68 having a stub portion 72 that extends through a central opening of exhaust gas port plate 58 onto which it is mounted by a retainer ring 74. The inner shroud has a cylindrical inlet 75 and an outlet 76 at each axial end. Between the end of shroud 50, an axial well is gradually formed having a depth and width slightly greater than that of gas outlet ports 61, 63, 65. The center body 68 abuts the inner surface of the well (not shown) and prevents flow of exhaust gas through the inlet orifice (not shown) from passing through the outlet ports. Instead, incoming exhaust gas is required to flow through the inlet ports 60, 62, 64 which are best illustrated in FIG. 2. The outer surface of the inner shroud seals the incoming exhaust gas from the outlet exhaust gas.

At the left end of the supercharger as shown in FIG. 1 the air duct assembly 12 includes an air duct 86 having plenum chambers 88, 90 that align axially with mating interior surfaces of the bearing housing 16. A web portion 92 of the bearing housing 16 seals chamber 88 from chamber 90 and provides a surface onto which air duct 86 is mounted. An inlet orifice (not shown) communicates with chamber 88 and carries inlet air at ambient conditions into the supercharger. Inlet air enters the rotor through the air inlet ports 93, 95, 97; compressed air exits the supercharger by passing through the air exit ports 94, 96, 99 formed through the thickness of the air port plate 98, the inner wall 97 and the web 92 of the bearing housing 16. The cylinders 100 are aligned with the exit ports in air port plate 98. Exiting air passes into chamber 90 and exits the air duct 96 through an intersecting duct that carries the compressed air into the inlet manifold of the internal combustion engine.

A rotor housing 104 has a cylindrical shroud 106 that extends axially between flange portions 108, 110. The flanges are mechanically attached to a bolt circle 112 to the air duct 86 that furnishes a tapped hole in alignment with the bolts and by way of a similar bolt circle 114 that aligns with the plurality of tapped holes formed in the port retainer flange 52.

A spacer shroud 116 is located within the rotor housing and extends between the exhaust gas port plate 58 at one end and the air port plate 98 at the opposite end. Shroud 116 receives spring pins 118, 119 in its axially opposite faces. Spring pins extend through plates 58, 98 and into the adjacent retainer flange 52 and bearing housing 16. The spring pins thereby position and align the inlet and outlet gas and air ports enabling flow of the engine exhaust gas and ambient air into and out of the supercharger.

The rotor 38 has a plurality of rotor vanes 120 that extend radially outwardly from the rotor hub 122 and are spaced around the circumference of the hub. The vanes are circumferentially spaced around the hub in one circumferential zone that may extend over approximately 126 degrees around the rotor circumference in increments that are about nine degrees apart, one vane from the other. A second zone adjacent the first extends over approximately 104 degrees of rotor circumference and has vanes within this zone spaced apart approximately eight degrees of rotor circumference. A third zone adjacent the first and second zones extends over approximately 130 degrees of rotor circumference and has vanes spaced apart approximately ten degrees of rotor circumference. The vanes are joined to the rotor hub 122 by brazing. The radially outer most ends of the vanes are brazed to a cylindrical sleeve 124 that extends axially the full length of the rotor.

The rotor, therefore, defines rotor cells 142 in the space bounded by adjacent vanes 120, the rotor hub 122 and the outer sleeve 124. The relationship between the cells 142 and the ports of the stator plates is carefully determined so that a pressure wave enters the rotor cells at the exhaust gas end of the supercharger and the energy of that wave is used to compress the ambient air that entered the cells through the air intake ports 94, 96, 99.

Referring again to FIG. 2, the exhaust gas port plate 58 has the inlet and outlet ports arranged around the rotor circumference symmetrically about the polar axis of the supercharger. The angular distance from the leading edge, taken with respect to the direction of rotation represented by vector C, of the inlet port 62 to the leading edge of the inlet port 64, which ports are associated with the first and second compression cycles, respectively, is approximately 120 degrees. The corresponding distance from the leading edge of inlet port 64 to the leading edge of inlet port 60, associated with the third compression cycle, is approximately 120 degrees. The angle subtended by the inlet ports 62, 64, 60 are equal and the angles subtended by the gas outlet ports 61, 63, 65 are equal. Similarly, the partitions between adjacent inlet and outlet exhaust gas ports have equal arcuate lengths.

Referring next to FIGS. 2 and 3, air outlet port 94 and air inlet port 97 are associated with a first compression cycle, the same cycle with which exhaust gas ports 62, 65 are associated. Air outlet ports 96 and inlet port 95 are associated with a second compression cycle, the same cycle with which exhaust gas ports 64 and 63 are associated. Air outlet port 99 and inlet port 93 are associated with a third compression cycle, the same cycle with which exhaust gas ports 60, 61 are associated. The angle extending between the leading edge, considered in the direction of rotation represented by a vector C, of the air outlet port 94 to the leading edge of the air outlet port 96 is different from the corresponding angle associated with the second and third compression cycles. Similarly, the angles subtended by the air outlet ports 94, 96, 99 are unequal and the angles subtended by the air inlet ports 93, 95, 97 are unequal. The partitions between adjacent air inlet and outlet ports on the air port plate 98 have unequal arcuate lengths.

Section 4–4 is taken through the mid-radial position of the ports in exhaust gas plate 58 and air port plate 98. This section is then extended linearly and spaced axially, the space therebetween representing the length of the rotor and the rotor cells. In this way, the approximate relationship of the four ports 62, 65, 94, 97 of the first compression cycle can be shown more clearly in their spaced relationship. Similarly, the phase relationship between the ports of the second and third compression cycles are illustrated in FIG. 4 in the order in which they occur as the rotor turns in the direction represented by vector C.

Operation of the supercharger will be explained with reference to FIG. 4. Two processes essential to the correct operation of a wave compression supercharger are a high pressure scavenge and low pressure scavenge. High pressure scavenge is that process by which high pressure exhaust gas is admitted to the supercharger rotor to compress the low pressure ambient air present in the cells. Critical to the correct operation of this process is the timing of the opening of the high pressure air outlet ports 94, 96, 99 that permit compressed air to be pumped into the engine intake manifold. This timing should be accomplished such that the compression wave created by the opening of the high pressure exhaust inlet port 60, 62, 64 reaches the air end of the rotor cell at precisely the same moment that the high pressure air outlet ports 94, 96, 99 open. It is important that the supercharger be underscavenged during this part of the compression cycle to prohibit exhaust gas regeneration (EGR) which may take place because there is not a sharply defined boundary between the exhaust gas and the pressurized air.

The low pressure scavenge is that process by which exhaust gas and expanded air remaining in the rotor after completion of the high pressure portion of the cycle are both exhausted through the low pressure exhaust gas port. Fresh air is drawn in through the air inlet ports 93, 95, 97 so that the compression process may be repeated. During this portion of the cycle it is important that the rotor be overscavenged to ensure that all of the expanded area is exhausted thus reducing the likelihood of EGR.

The compression process is described with respect to the first compression cycle. Initially, rotor cell 120 is filled with air at ambient conditions, because as can be seen from FIG. 4, air inlet port 93 has remained open after exhaust gas outlet port 61 closed. Exhaust gas inlet port 62 is opened because a rotor cell has rotated into registry with port 62. A compression or shock wave is produced when the cells rotate into communication with high pressure inlet port 62. The compression wave travels along the rotor cell ahead of the high pressure exhaust gas thereby compressing the air present within the cell, which is closed at the air side during a portion of the time during which exhaust gas flows into the cell through port 62. Next, rotation brings the cell into registry with air outlet port 94 and the compression wave, which has traveled along the rotor length at the speed of sound, pumps the air from the rotor into the engine inlet manifold. For efficient operation the compression wave should reach the air side of the cell precisely as air outlet port 94 opens. Since the compression wave travels axially along the rotor length at approximately a fixed speed, the speed of sound in the mixture, the speed of the rotor and the location of the leading edge of the air exhaust port 94 with respect to the leading edge of the exhaust gas inlet port 62 determine the efficiency of the underscavenged compression process. The port sizing and dwell period between adjacent ports of the second and third compensation cycles are designed to be compatible with efficient operation of rotor speeds other than the optimal speed of the first compression cycle.

The compresson wave rebounds from the interior surface of port plate 98 and retreats along the cell to the exhaust gas side of the rotor. However, before this occurs, exhaust gas inlet port 62 is closed to prevent further flow of exhaust gas into the cell. In approximately the same manner exhaust gas is scavenged from the rotor and fresh air inducted as the rotor all passes the low pressure air and gas ports 65, 97. This low pressure scavenge process causes the expanded exhaust gas to be exhausted from the rotor through the exhaust gas outlet port 65. When the cell is rotated into registry with port 65, an expansion wave eminating from the leading edge of the exhaust gas outlet port 65 begins the low pressure scavenge process. That pressure wave travels across the rotor to the interior surface of port plate 98 and rebounds from that surface before the rotor cell is rotated into registry with air inlet port 97. When the cell passes the leading edge of port 97, ambient air flows into the cell behind the returning pressure wave and for a relatively long period both the exhaust gas outlet port 65 and the air inlet port 97 are open. This causes scavenging of the exhaust gas from the rotor and during this process fresh air flows entirely along the cell length toward the exhaust gas side through exhaust gas port 65 and partially into the exhaust gas system. In this way, the exhaust gas-air interface is completely flushed from the rotor cell before gas port 65 closes. Again, for a short period following closure of exhaust gas port 65, air inlet port 97 remains open to assure that the entire rotor cell is filled with ambient air before the second compression cycle begins upon opening exhaust gas inlet port 64 to the rotor cell.

Changes and modifications in the specifically described embodiments can be carried out without departing from the scope of the invention which is intended to be limited by the scope of the appended claims.

Having thus described a preferred embodiment of our invention what we claim and desire to secure by U.S. Letters Patents is:

1. A three cycle compression wave supercharger for compressing air supplied to an engine comprising:

a rotor mounted for rotation about an axis having vanes extending radially therefrom and distributed circumferentially about the axis, the vanes defining rotor cells therebetween that extend along the axis;

an exhaust gas port plate located at a first axial end of the rotor having three inlet gas ports through which exhaust gas from the engine enters the rotor cells and three outlet gas ports through which exhaust gas exists the rotor cells, the inlet and outlet gas ports being located alternately around the axis forming pairs that include one inlet and one outlet gas port, each pair associated with one compression cycle, the angles subtended by each pair being equal;

an air port plate located at the axially opposite end of the rotor from that of the first end having three air inlet ports through which air at low pressure enters the rotor cells and three air outlet ports through which compressed air exits the rotor cells, the inlet and outlet air ports being located alternately around the axis forming pairs that include one inlet and one outlet air port, each pair associated with one compression cycle, the angle subtended by a first air port pair being different from the angle subtended by the second and third air port pairs, the angular dimension of the openings of the air inlet ports of the first, second and third pairs being different one from another, the angular dimension of the openings of the air outlet ports of the first, second and third pairs being different one from another.

2. The supercharger of claim 1 wherein for each compression cycle the gas inlet port opens before the air outlet port opens and closes while the air outlet port is open.

3. The supercharger of claim 1 wherein for each compression cycle the gas outlet port opens before the air inlet port opens and closes while the air outlet port is open.

* * * * *